US005606918A

United States Patent [19]

Cauffiel

[11] Patent Number: 5,606,918

[45] Date of Patent: *Mar. 4, 1997

[54] TABLE ASSEMBLY WITH BASE PLATES FOR USE WITH SEATING APPARATUS

[76] Inventor: Ford B. Cauffiel, 4126 Nantucket Dr., Toledo, Ohio 43623

[ * ] Notice: The term of this patent shall not extend beyond the expiration date of Pat. No. 5,479,865.

[21] Appl. No.: 559,936

[22] Filed: Nov. 17, 1995

Related U.S. Application Data

[63] Continuation-in-part of Ser. No. 102,916, Aug. 6, 1993, Pat. No. 5,479,865.

[51] Int. Cl.[6] ..... A47B 23/00

[52] U.S. Cl. ..... 108/42; 108/49

[58] Field of Search ..... 297/144, 135, 297/170, 172, 423.39, 423.4, 423.1; 108/42, 49; 248/188, 345.1

[56] References Cited

U.S. PATENT DOCUMENTS

| | | | |
|---|---|---|---|
| 2,612,422 | 9/1952 | Sarkus | 108/49 X |
| 5,038,434 | 8/1991 | Navarrette | 108/49 X |
| 5,129,702 | 7/1992 | Ervin | 108/49 X |
| 5,144,898 | 9/1992 | Posly | 108/49 X |
| 5,293,825 | 3/1994 | Cauffiel | 108/49 |
| 5,409,296 | 4/1995 | Barile | 297/172 X |
| 5,479,865 | 1/1996 | Cauffiel | 108/49 X |

FOREIGN PATENT DOCUMENTS

| | | | |
|---|---|---|---|
| 2660535 | 10/1991 | France | 108/49 |
| 208625 | 12/1923 | United Kingdom . | |
| 407696 | 3/1934 | United Kingdom | 297/135 |

*Primary Examiner*—Jose V. Chen
*Attorney, Agent, or Firm*—Allen D. Gutchess, Jr.

[57] ABSTRACT

A table assembly for seating apparatus has from one to four base assemblies positioned under one to four corner support portions of the seating apparatus. A first elongate base plate of the first base assembly extends under a first support portion on one side of the seating apparatus and extends toward a second side, projecting beyond the first side. A receptacle is affixed to the projecting portion of the first base plate and extends rearwardly toward a second base assembly, when used, under a second support portion. A rigid member connects the receptacle and the second base assembly which has an adjustable stop abutting an end of the second support. A third base assembly, when used, has a base plate under a third support portion of the seating apparatus on the second side and has an attached rigid member connected to the first base plate. A fourth base assembly, when used, is under a fourth support portion and also has an adjustable stop. A flexible member, when all four base assemblies are used, extends around the adjustable stop of the fourth base plate assembly to hold the stop in place. The base plate assemblies are designed so that the receptacle and a table-supporting post can be located on the other side of the seating apparatus, if desired. Jacks can be used between the first base plate and a frame member of the seating apparatus for adding stiffness to the first base plate. A special tilt assembly holds the table securely in a horizontal position, yet enables it to be readily titled.

22 Claims, 4 Drawing Sheets

TABLE ASSEMBLY WITH BASE PLATES FOR USE WITH SEATING APPARATUS

This application is a continuation-in-part of my application Ser. No. 08/102,916, filed Aug. 6, 1993, now U.S. Pat. No. 5,479,865.

This invention relates to a table assembly for use with seating apparatus.

The table assembly can be Separated completely from the seating apparatus for storage or for use with other seating apparatus. The seating apparatus can include chairs, recliners, sofas, love seats, and the like. The apparatus has supports on each side thereof which can extend the full depth of the seating apparatus, as in the case of recliners, with front and rear support portions. For other seating apparatus, the front and rear support portions can be separate legs.

The table assembly includes one or more base plates which are located under one or more of the support portions of the seating apparatus. The base plates can be used under one, two, three, or four of the support portions of the seating apparatus. Preferably, the base plates are located under front and rear support portions on a first side of the seating apparatus. However, they can also be used under both front support portions on both sides of the seating apparatus. They can also be used under three of the support portions or under all four support portions of the seating apparatus.

When a first base plate is used under a front support portion on a first side of the seating apparatus, the base plate extends toward the front support portion on the second side of the seating apparatus and has a projecting portion extending beyond the first side of the seating apparatus. An elongate receptacle having side walls connected by a bottom wall extends along the first side of the seating apparatus and is attached to the projecting portion of the first base plate. A lower sleeve extends upwardly from the bottom wall of the receptacle above the projecting portion of the base plate to receive a post. A bracket and a table are connected to the top of the post as shown, for example, in the aforesaid copending application. The portion of the base plate extending toward the second side of the seating apparatus can have a plurality of holes extending therethrough on a line perpendicular to the front edge of the base plate to receive a jack. An adjustable jack has threaded shanks, a lower end of one of which is received in one of these holes while the upper end is raised or lowered through the turning of the threaded shanks to engage a frame member of the seating apparatus.

A second base plate can be used under the rear support portion on the first side of the seating apparatus. An adjustable stop can be located above and contacting the second base plate but is movable relative to the plate. The adjustable stop can have a tube-receiving member extending outwardly therefrom on the same side of the seating apparatus. A rigid connecting member or tube can then be affixed to the bottom wall of the receptacle and extend rearwardly through the tube-receiving member. The tube and tube-receiving member have an adjustment, either in the form of a pin and holes, or even setscrews, which adjust the position of the stop to engage the rear end of the rear support portion. This helps to keep the seating apparatus in place and also enables the seating apparatus and base plates to be moved outwardly for cleaning purposes or the like.

A third base plate can be located under the front support portion of the seating apparatus on the second side thereof. This can be used in place of, or in addition to, the second base plate. When the third base plate is used, it can be connected to the first base plate by a rigid member in the form of a tube or angle iron having holes therein with holes also being located under front edge portions of the first and third plates. These latter holes can be located at one-inch increments for example, so that the rigid member and the first and third base plates can be adjusted at one-inch increments.

A fourth base plate can be located under the rear support portion on the second side of the seating apparatus. This can have an adjustable stop with a second tube-receiving member projecting beyond the second side of the seating apparatus. If the first and third base plates and the receptacle are reversed, to place the receptacle and lower sleeve on the second side of the seating apparatus, then the tube on the first side of the apparatus can be remounted in the receptacle and received in the second tube-receiving member. The first base plate has additional holes, along with the receptacle, to receive the front rigid member and also the tubular member when on the second side of the seating apparatus.

The second tube-receiving member also has an additional function. Accordingly, a suitable, flexible elongate member in the form of a strand or wire or even a strap can be affixed to the first adjustable end stop of the second base plate, extend around the back of the second adjustable end stop and through the second tube-receiving member, and then affixed to an end portion of the front rigid member connecting the first and third plates. This holds the fourth base plate in place.

The table of the table assembly is connected to an upper bracket assembly on the post and a bracket is affixed to the bottom of the table through threaded fasteners. In this instance the bottom of the table has two sets of three threaded holes perpendicular to the longitudinal extent of the table to receive threaded fasteners extending through the bracket. With this arrangement, the table can be mounted on the bracket in three different locations to accommodate the body of the particular user of the table assembly.

As disclosed in the aforesaid application, the table can be tilted to any desired angle. However, with a flat lower edge on the outer flanges of the bracket assembly and with a flat on a washer therebelow, the table is more securely held in a horizontal position when a knob is tightened. At the same time, the table can be tilted to any desired position when the knob is loosened and then retightened.

If desired, the table can have a lower shelf connected by side and end walls to the table with the bracket fastened to the bottom of the shelf. This provides a gap between the shelf and the table for receiving books or computer accessories, or the like.

It is, therefore, a principal object of the invention to provide a table assembly for seating apparatus having the features and advantages discussed above.

Various other objects and advantages of the invention will be apparent from the following detailed description of preferred embodiments thereof, reference being made to the accompanying drawings, in which.

Figure 1:
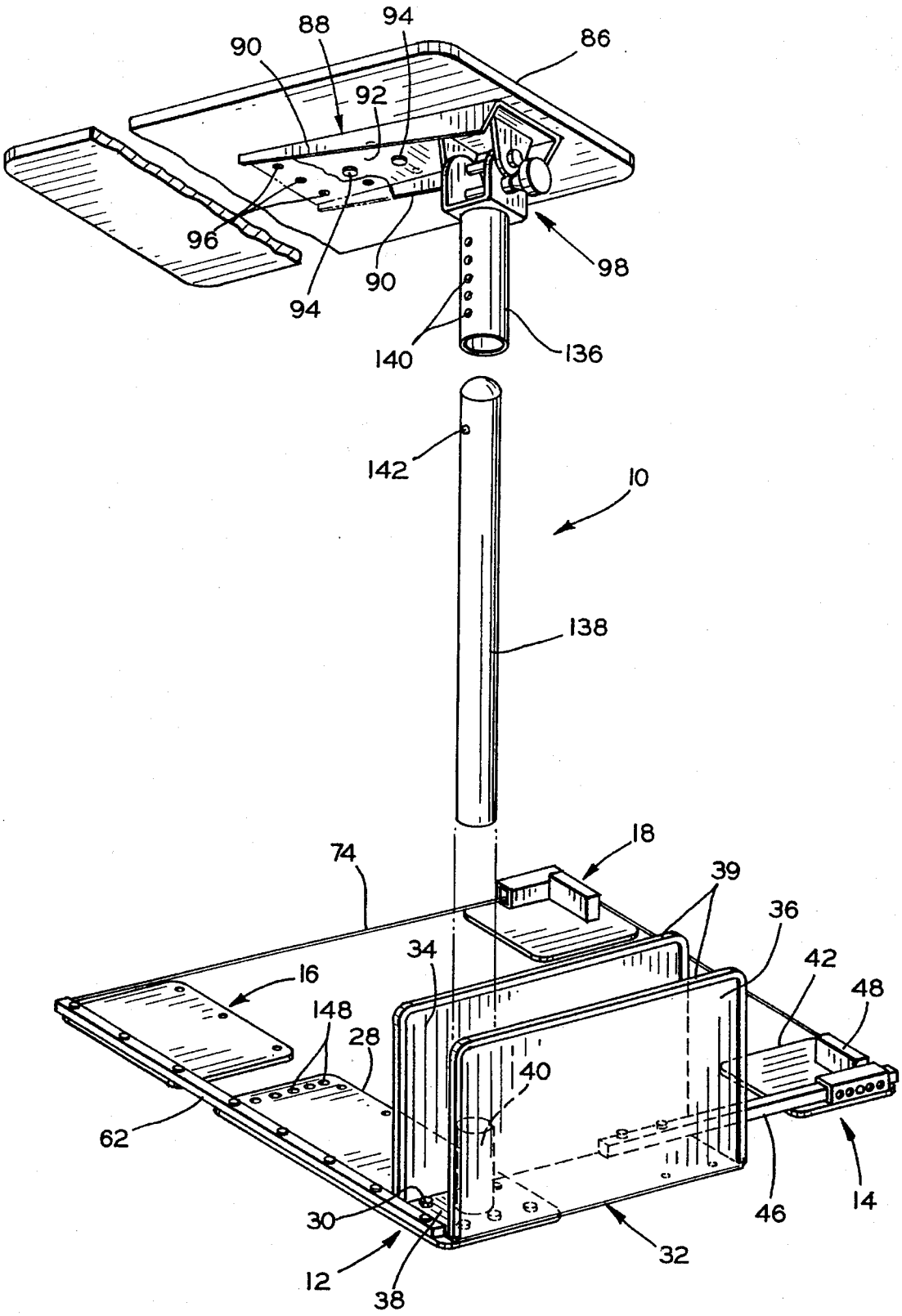
FIG. 1 is an exploded view in perspective, with parts broken away, of a table assembly embodying the invention.

Referring to the drawings, and more particularly to FIG. 1, a table assembly in accordance with the invention is indicated at 10. As shown, the overall assembly includes four base plate assemblies indicated at 12, 14, 16, and 18. There are designed and positioned to receive support portions 20, 22, 24, and 26, indicated in dotted lines in FIG. 2, of seating apparatus. These support portions can be legs of the seating apparatus or end portions of supports that extends the full depth of the seating apparatus on both sides thereof.

The base plate assembly 12 can be used alone with the support portion 20 under the front corner of the seating apparatus. It can also be used with the base plate assembly 14 under the support portion 22 on the same side of the seating apparatus. Further, the base plate assembly 12 can be used with the base plate assembly 16 under the support portion 26 at the other front corner of the seating apparatus. Further, all three of the base plate assemblies 12, 14, and 16 can be used with the addition of the fourth base plate assembly 18. Preferably, when only two of the base plate assemblies are used, they are positioned along the side or the front of the seating apparatus to provide a more stable condition.

The base plate assembly 12 includes a first elongate base plate 28 which extends toward the support portion 24 on the second side of the seating apparatus and projects outwardly beyond the first side thereof. The projecting portion has threaded holes to receive six fasteners in the form of machine screws 30, for example. These attach a receptacle 32 to the projecting portion of the base plate 28. The receptacle 32 has two parallel side walls 34 and 36 connected by a bottom wall 38, with the fasteners 30 extending through the bottom wall 38. Rubber strips 39 can be placed over edges of the side walls 34 and 36 for protective and decorative purposes. A lower sleeve 40 extends upwardly from a front portion of the bottom wall 38 of the receptacle 32. A rear portion of the bottom wall 38 also has symmetrical pairs of threaded holes 42 to receive threaded fasteners or machine screws 44. These are used with an elongate rigid member or connecting tube 46 when the second base plate assembly 14 is employed. With the receptacle 32 connecting the base plate 28 and the rigid member 46, the receptacle 32 acts as a structural component as well as being for storage. The symmetrical holes 42 enable the rigid member or connecting tube 46 to be affixed to the other side of the receptacle 32, near the side wall 34, when the base assembly 12 is used on the second side of the seating apparatus, as will be discussed in more detail subsequently.

Figure 2:
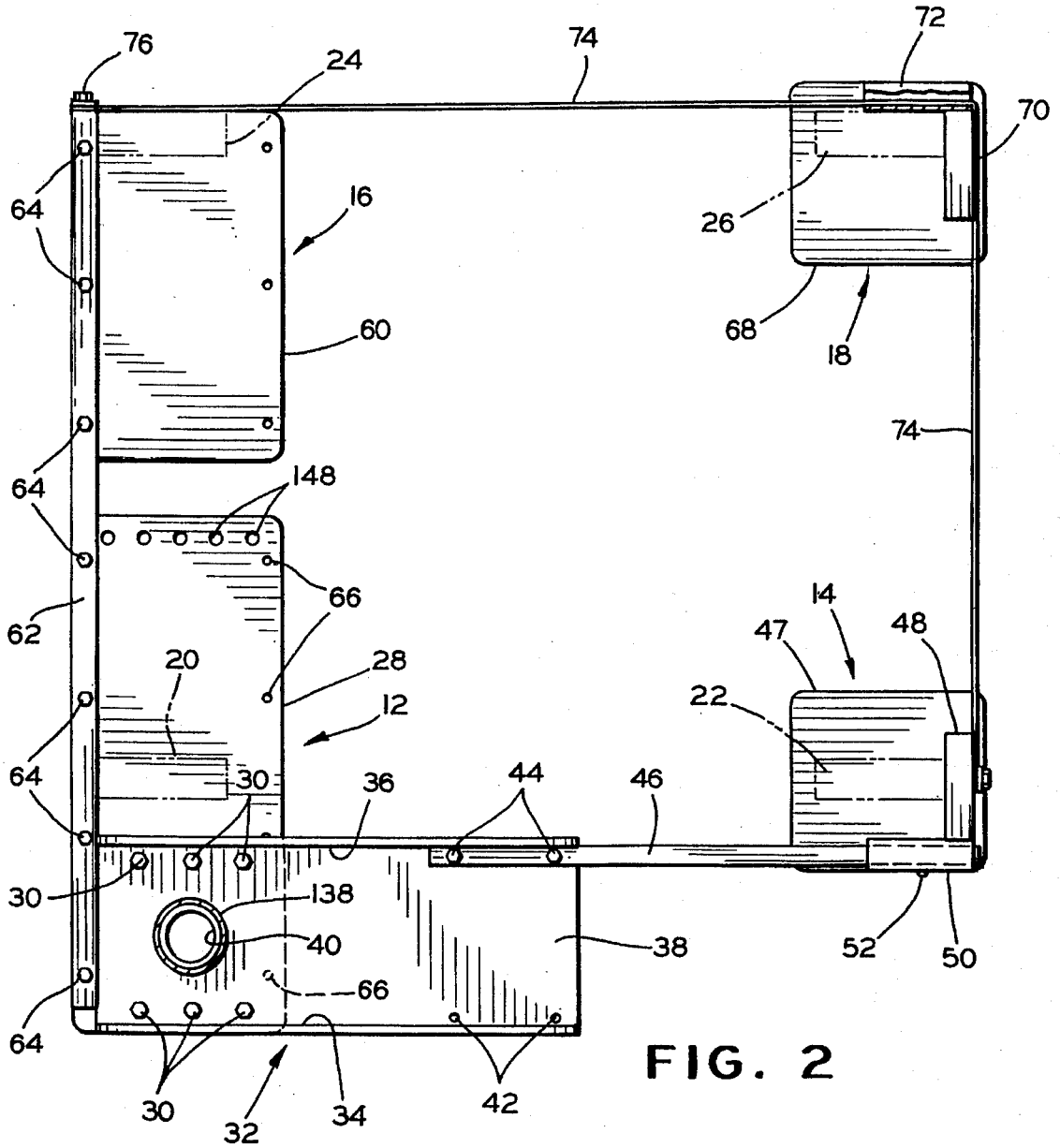
FIG. 2 is a plan view of a base assembly of FIG. 1 with seating apparatus support portions shown in dotted lines.
Figure 3:
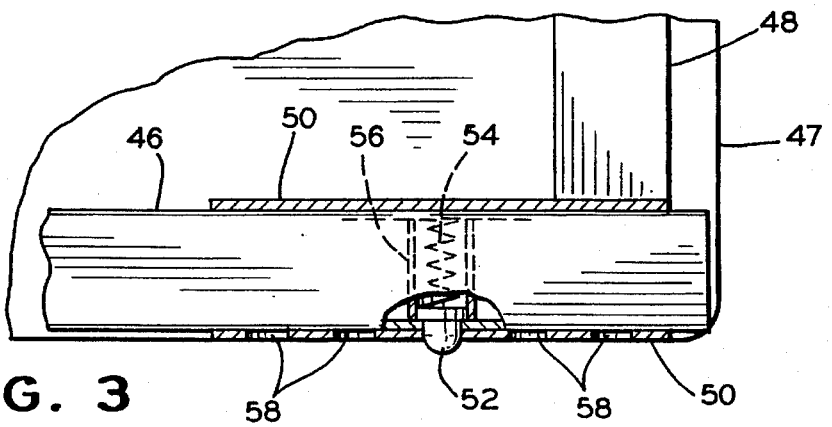
FIG. 3 is an enlarged, fragmentary plan view with parts shown in section, of a tube and a rear base plate with a tube-receiving member mounted on an adjustable stop.

When the second base plate assembly 14 is employed, it has a base plate 47 positioned under the rear support portion 22. An adjustable stop 48 rests on the base plate 47 and is movable relative thereto. The stop is affixed to a tube-receiving member or means 50 into which the rigid member 46 extends. The rear of the rigid member or tube 46 has a pin 52 (also see FIG. 3) which is urged outwardly by a spring 54 located in a tube 56 in the rigid member 46. The pin 52 extends outwardly through any of a plurality of holes 58 in the tube-receiving means 50 for enabling adjustment of the adjustable stop 48 relative to the first base plate assembly 12. The stop 48 is adjusted by depressing the pin 52 and moving the tube-receiving means 50 to align the pin 52 with another one of the holes 58. The adjustable stop 48 then engages the end of the rear support portion 22 of the seating apparatus as shown in FIG. 2.

When the third base plate assembly 16 is used with the first base plate assembly 12, a base plate 60 of the assembly 16 is connected to the base plate 28 by an elongate rigid member 62 which is preferably tubular but can also be of an angle iron shape in cross section, for example. The rigid member 62 is connected to the base plate 60 by three threaded fasteners 64 which are received in three symmetrical holes (not shown) in an edge portion of the base plate 60. The rigid member 62 is also affixed to the base plate 28 by additional ones of the threaded fasteners 64 which extend through threaded holes 66 which are located on both edges of the plate 28 so that the base plate 28 can be used on either side of the seating apparatus. The base plates 28, 60, and the rigid member 62 are not visible or barely visible under most seating apparatuses.

The fourth base plate assembly 18 includes a base plate 68 which, when employed, is located under the fourth rear support portion 26. The assembly 18 also has an adjustable stop 70 affixed to a second tube-receiving member or means 72.

When the base plate assembly 12 is used on the second side of the seating apparatus, the plate 28 is turned 180° and the projecting portion projects out from the second side of the seating apparatus. The receptacle 32 is reattached to the projecting portion of the base plate 28 by the same screws 30, with the receptacle then extending rearwardly along the second side of the seating apparatus. The rigid member 46 is then attached by the screws 44 to the threaded holes 42 along the opposite edge of the bottom wall 38 with the rigid member 46 extending through the tube-receiving means 72 in the same manner as the tube-receiving means 50. The base plate 60 is simply moved under the support portion 20 without re-orientation.

Figure 4:
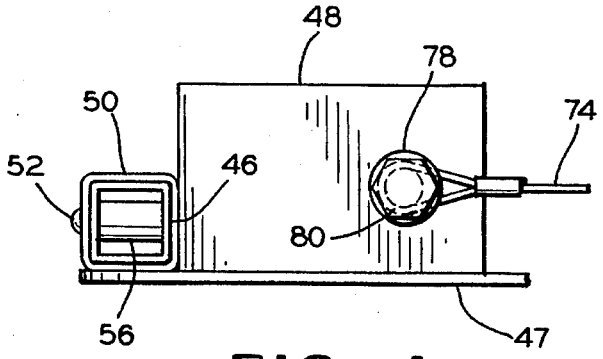
FIG. 4 is a rear view of the components of FIG. 3 with an elongate flexible member attached to the adjustable stop.
Figure 5:
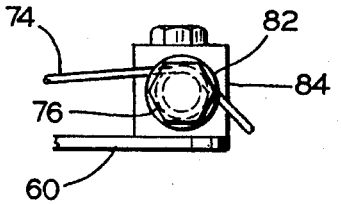
FIG. 5 is an end view showing the elongate, flexible member of FIG. 4 attached to an end of a rigid tube connecting two front base plates.

However, when the base assembly 12 is located on the first side of the seating apparatus, as shown, there is no means to maintain the adjustable stop 70 in place. In that instance, an elongate, flexible member in the form of a strand or strap 74 (FIGS. 1 and 2) extends from the adjustable stop 48 around the back of the seating apparatus and through the tube-receiving member 72. It is then pulled forwardly and attached by a screw 76 to an end of the rigid member 62. For this purpose, the flexible member is looped around a washer 78 and a threaded fastener 80, as shown in FIG. 4. At the opposite end, the screw 76 along with a washer 82 are threaded into a block 84 (FIG. 5) in the end of the rigid member 62. The flexible member 74 is partially wound around the screw 76, under the washer 82, and pulled until there is sufficient tension on the flexible member 74. The screw 76 is then tightened and the base assembly 18 is then held securely in place.

The adjustable stops 48 and 70, abutting the ends of the support portions 22 and 26, then enable the entire four base assemblies to be moved outwardly along with the seating apparatus to enable the overall table assembly to be moved for cleaning purposes or to reposition the overall assembly.

Referring to FIG. 1, the table assembly 10 includes a table 86 which is elongate in shape and of ample size to comfortably hold food and refreshments or equipment, such as a computer, word processor, typewriter, etc. A supporting bracket 88 is located under an end portion of the table 86 and extends a substantial distance toward the other end. The supporting bracket 88 includes tapered side flanges 90 and a wide web 92. The web has central openings receiving threaded fasteners, such as machine screws 94. The bottom of the table 86 has three sets of three holes 96 for each of the screws 94. The screws 94 are threaded into corresponding ones of the three openings 96 for each series thereof. This enables the bracket 88 to be located in any of three positions under the table 86 so that the table can be located closer to or further from the user of the seating apparatus. This enables the table to be positioned according to the size of the user, thus constituting a body adjustment for the table assembly.

Figure 6:
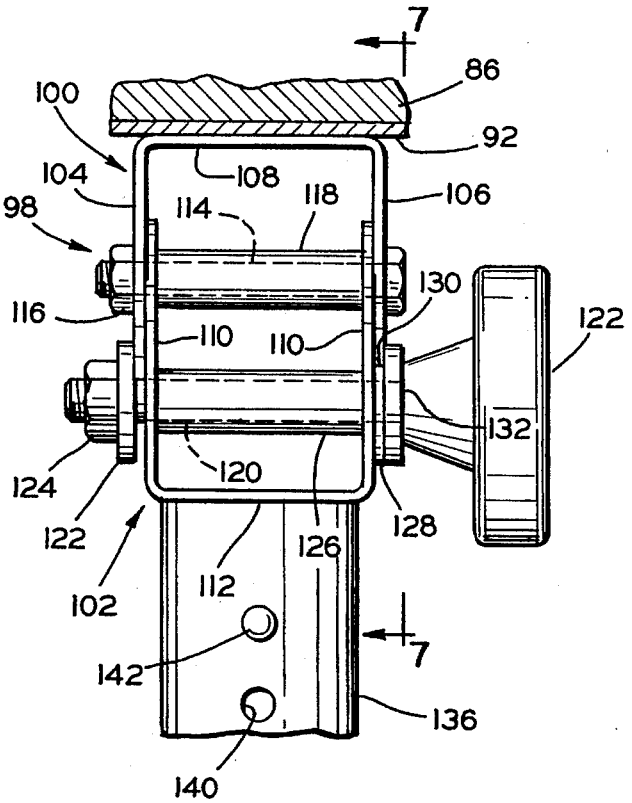
FIG. 6 is a fragmentary end view of a tilt assembly for the table of FIG. 1.
Figure 7:
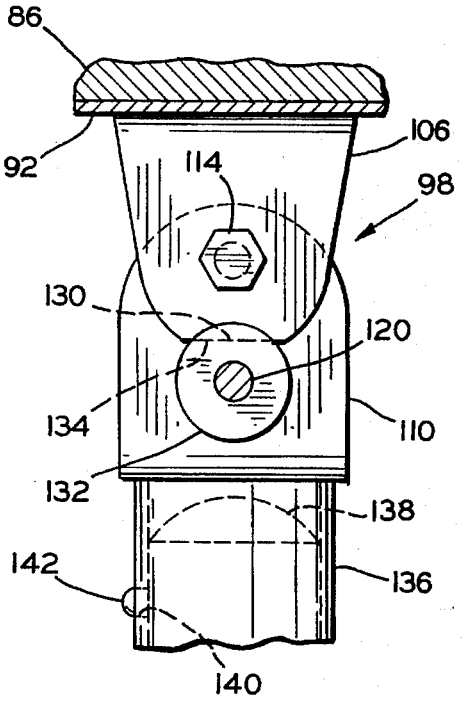
FIG. 7 is a view, partly in section, taken along the line 7—7 of FIG. 6.

Referring to FIGS. 1, 6, and 7, a tilt assembly 98 is affixed to an end portion of the supporting bracket web 92. This assembly includes an upper bracket 100 and a lower bracket 102. The upper bracket 100 has downwardly-extending parallel flanges 104 and 106 connected by a web 108. The lower bracket 102 has upwardly-extending flanges 110 which extend inside and partially nest with the flanges 104 and 106. The lower bracket 102 also has a web 112.

The flanges of the brackets has matching holes through which a pivot bolt 114 extends and has a nut 116 beyond the flange 104. A sleeve 118 surrounds the shank of the bolt 114 to prevent the flanges from collapsing with the table 86 pivoting about the bolt 114.

A bolt 120 is located through the flanges 110 of the lower bracket 102 and is turned by a knob 122. The bolt 120 has a washer 122 and a nut 124 on the opposite side of the bracket. A sleeve 126 surrounds the shank of the bolt 120 to prevent the flanges 110 of the lower bracket 102 from collapsing. In this instance, a washer 128 with an upper flat edge 130 is located between the one flange 110 and a washer 132 located between the washer 128 and an end of the knob 122. The flat 130 of the washer 128 cooperates with a lower flat edge 134 of the flange 106 to hold the table 86 securely in a horizontal position when the knob 122 is tightened to prevent tilting of the table even if a heavy object is located thereon. When the knob 122 is loosened, the table can be tilted in the usual manner.

An upper sleeve 136 is affixed to the bottom web 112 of the bracket 102. The upper sleeve 136 receives an upper end of a post 138, the lower end of which is received over the lower sleeve 40 (FIG. 1). The upper sleeve 136 has a plurality of openings 140 therein for height adjustment. For this purpose, the upper end of the post 138 has a depressible spring-loaded pin 142 which can be positioned in any of the openings 140 of the sleeve 136 to adjust the table height. In this instance, that table 86 can be swung in a horizontal plane by pivoting the table 86 to turn the post 138 relative to the lower sleeve 40.

Figure 8:
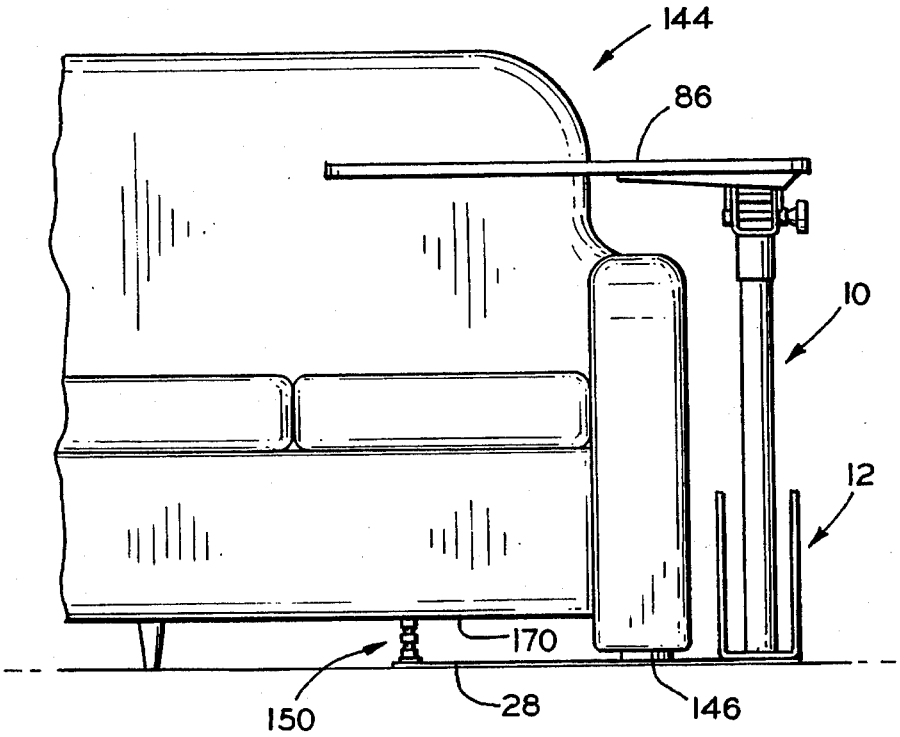
FIG. 8 is a fragmentary front view of seating apparatus with a front base plate and table assembly of FIG. 1 and further with a jack engaging an end portion of the base plate.
Figure 9:
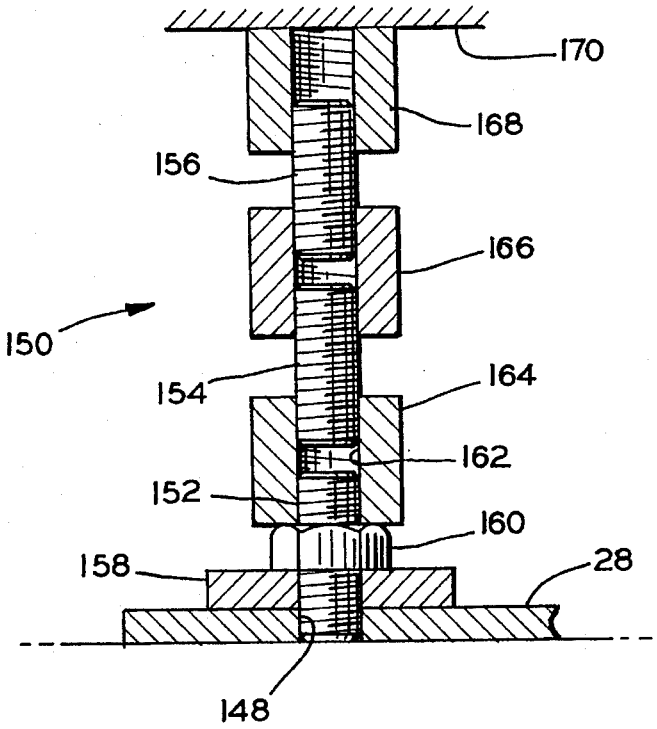
FIG. 9 is an enlarged, schematic view in cross section of the jack shown in FIG. 8.

Referring to FIGS. 8 and 9, seating apparatus 144 is shown in the form of a couch, love seat, or the like. It is employed with the table assembly 10 and specifically the base assembly 12. A front support portion or leg 146 of the seating apparatus is located on the base plate 28 in a position similar to that of the support portion 20 as shown in FIG. 2. The base plate 28 can tend to turn upwardly at its inner end when the table 86 is swung out of the way and particularly when swung toward a 180° position from that shown. To overcome this, the base plate 28 has a plurality, in this case five, jack holes 148 along an inner end portion thereof (see FIGS. 1 and 9). A jack 150 is located in one of the holes 148 to maintain the end of the base plate 28 in place, with the jack 150 being engaged with a portion of the frame of the seating apparatus 144.

The jack 150 can be of various designs. As shown schematically in FIG. 9, the jack includes a lower threaded rod or shank 152, a middle threaded rod or shank 154, and an upper threaded rod or shank 156. The lower threaded shank 152 extends into one of the jack holes 148 in the base plate 28 through a plate 158 and a nut 160. The upper end of the threaded shank 152 extends into a threaded opening 162 in a lower block 164. The intermediate threaded shank 154 is threaded into the lower block 164 and also into an intermediate block 166. Similarly, the upper threaded shank 156 is threaded into the intermediate block 166 and into an upper block 168.

The upper block-168 is turned on the shank 156 to engage the lower surface of a frame member 170 of the seating apparatus 144. To accommodate narrower spacing between the base plate 28 and the frame member 170, one or both of the blocks 168 and 166 along with the shanks 156 and 154 can be removed and disposed of, according to the particular spacing involved.

When the base plate assembly 16 of FIG. 1 is not employed, with the rigid member 62 then not being used, one of the jacks 150 can also be used in one of the holes 148 of the base plate 28 (FIG. 1) to provide stability for the overall table assembly.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A table assembly and seating apparatus having front and rear support portions on a first side thereof, said table assembly comprising stabilizing means defined by a first base plate to be received under and held stationary by said front support portion, said first base plate having a bottom surface for defining a floor engaging means contacting a floor under the front support portion, said first base plate extending under the seating apparatus toward a second side thereof, said first base plate having a projecting portion projecting outwardly beyond the first side of the seating apparatus, an elongate receptacle located on the same side of the seating apparatus as said projecting portion of said first base plate and extending rearwardly therefrom, said receptacle having two side walls and a bottom wall extending therebetween, a lower sleeve extending upwardly from the bottom wall of said elongate receptacle above the projecting portion of said first base plate, and means affixing a forward portion of said elongate receptacle to the projecting portion of said first base plate.

2. A table assembly and seating apparatus according to claim 1 wherein a second base plate is located under the rear support portion of said first side of said seating apparatus, and a first adjustable stop is located above said second base plate and adapted to contact an end of the rear support portion of said seating apparatus.

3. A table assembly and seating apparatus according to claim 2 wherein connecting means connects said elongate receptacle and said adjustable end stop.

4. A table assembly and seating apparatus according to claim 2 wherein a tube-receiving means is affixed to said adjustable end stop, a tube is affixed to said receptacle and extends into said tube-receiving means, and means adjustably affixes said tube to said tube-receiving means.

5. A table assembly and seating apparatus according to claim 1 wherein the portion of said first base plate extending toward the second side of the seating apparatus has a plurality of holes extending therethrough on a line perpendicular to the longitudinal extent of said first base plate to receive a jack.

6. A table assembly and seating apparatus according to claim 5 wherein a jack has threaded shaft means with a lower end thereof received in one of said holes and an upper block threadedly receiving said threaded shaft means and is adapted to engage an underside structure of said seating apparatus to help maintain said first base plate in place.

7. A table assembly and seating apparatus according to claim 1 wherein a third base plate is located under a front support portion under the second side of said seating apparatus.

8. A table assembly and seating apparatus according to claim 7 wherein a fourth base plate is located under a rear support portion under the second side of said seating apparatus.

9. A table assembly and seating apparatus according to claim 8 wherein a second adjustable end stop is located above said fourth base plate and has second tube-receiving means extending outwardly beyond said second side of said seating apparatus.

10. A table assembly and seating apparatus according to claim 9 wherein an elongate flexible member extends from a portion of the seating apparatus near the rear end support means of said first side, along the back of said seating apparatus, through said second tube-receiving means of said fourth base plate, and to said third base plate, to hold said fourth base plate in place.

11. A table assembly and seating apparatus according to claim 7 wherein said first and third base plates are connected by a rigid member which is affixed by threaded fasteners to said first and third base plates with said rigid member being adjustably affixed to said first and third base plates at incremental spacings.

12. A table assembly and seating apparatus having front and rear support portions on a first side thereof, said table assembly comprising stabilizing means defined by a first base plate to be received under and held stationary by said front support portion, said first base plate having a bottom surface for defining a floor engaging means contacting a floor under the front support portion, said first base plate extending under the seating apparatus toward a second side thereof, an elongate receptacle located on the same side of the seating apparatus as said first base plate and extending rearwardly therefrom, said elongate receptacle having two side walls and a bottom wall extending therebetween, a lower sleeve extending upwardly from the bottom wall of said elongate receptacle, means affixing a portion of said elongate receptacle to said first base plate, said first base plate having at least one opening near an end thereof extending toward the second side of the seating apparatus, and an adjustable jack received in said opening and engaging a frame member of said seating apparatus.

13. A table assembly and seating apparatus according to claim 12 wherein a second base plate is located under the rear support portion of said first side of said seating apparatus, an adjustable stop located above said second base plate, rigid connecting means adjustably connected to said adjustable stop and affixed to said bottom wall of said elongate receptacle, whereby said elongate receptacle acts as a structural member for said first base plate and said second base plate.

14. A table assembly according to claim 13 wherein a tube-receiving means is affixed to said adjustable stop and said rigid connecting means extends into said tube-receiving means and is adjustably affixed thereto.

15. A table assembly and seating apparatus having front and rear support portions on a first side thereof, said table assembly comprising stabilizing means defined by a first base plate to be received under and held stationary by said front support portion, said first base plate having a bottom surface for defining a floor engaging means contacting a floor under said front support portion, said first base plate extending under the seating apparatus toward a second side thereof, an elongate receptacle located on the same side of the seating apparatus as said first base plate and extending rearwardly therefrom, a lower sleeve extending upwardly from said elongate receptacle, means affixing a portion of said elongate receptacle to said first base plate, another base plate to be received under and held stationary by a front support portion on the second side of said seating apparatus, and a rigid member adjustably attached to said first and another base plates near edge portions thereof toward the front support portions of the seating apparatus.

16. A table assembly and seating apparatus according to claim 15 wherein said rigid member is adjustably affixed to said first and another base plates by threaded fasteners extending through threaded holes in forward edge portions of said first and another base plates.

17. A table assembly and seating apparatus according to claim 16 wherein said first base plate has a plurality of equally spaced openings along a rear edge portion thereof whereby said first base plate can be positioned on the second side of said seating apparatus by being reversed.

18. A table assembly and seating apparatus according to claim 15 wherein said elongate receptacle is mounted on a projecting portion of said first base plate on one of said first and second sides of said seating apparatus.

19. A table assembly and seating apparatus according to claim 15 wherein an additional base plate is located under a rear support portion on the first side of said seating apparatus.

20. A table assembly and seating apparatus according to claim 19 wherein a fourth base plate is located under a rear support portion on the second side of said seating apparatus.

21. A table assembly and seating apparatus according to claim 15 wherein a post is mounted on said lower sleeve, an upper sleeve is mounted on an upper end of said post, and a tilt assembly is mounted on said upper sleeve, a table, and means attaches said tilt assembly to a bottom of said table, said tilt assembly having flat portions to more securely hold said table when in a horizontal position.

22. A table assembly and seating apparatus according to claim 15 wherein a post is mounted on said lower sleeve, an upper sleeve is mounted on said post, a longitudinal table, a plurality of holes are located in a bottom portion of said longitudinal table and extending transversely thereof, a bracket is connected to said upper sleeve, and fastener means fastens said bracket to any one of the holes in the bottom portion, whereby said table can be moved closer to or farther from a user sitting on the seating apparatus.

* * * * *